United States Patent [19]

Bridges

[11] Patent Number: 4,930,628

[45] Date of Patent: Jun. 5, 1990

[54] STORAGE AND DISPLAY CASE HAVING PIVOTALLY MOUNTED COVER

[75] Inventor: John A. Bridges, Nashville, Tenn.

[73] Assignee: Aladdin Industries Inc., Nashville, Tenn.

[21] Appl. No.: 273,563

[22] Filed: Nov. 21, 1988

[51] Int. Cl.[5] ..... B65D 5/52; B65D 85/20; B65D 25/24

[52] U.S. Cl. ..... 206/45.23; 206/45.14; 206/45.31; 206/373; 206/378; 211/126; 220/18; 220/337; 312/245

[58] Field of Search ..... 220/335, 337, 342, 343, 220/338, 306, 18; 206/45.14, 45.19, 45.2, 45.23, 45.31, 45.34, 349, 372–379; 211/70.6, 126, 88; 312/245

[56] References Cited

U.S. PATENT DOCUMENTS

| | | | |
|---|---|---|---|
| 1,989,159 | 1/1935 | Shiffman et al. | 206/45.23 |
| 2,527,161 | 10/1950 | Tyll | 206/372 |
| 2,852,054 | 9/1958 | Motley | 220/306 |
| 3,272,379 | 9/1966 | Driza et al. | 220/335 |
| 3,327,841 | 6/1967 | Schuman et al. | 206/349 |
| 3,381,636 | 10/1966 | Saiberlich . | |
| 3,669,035 | 6/1972 | Grossman . | |
| 3,913,711 | 10/1975 | Schmid | 206/45.23 X |
| 4,131,203 | 12/1978 | Bridges . | |
| 4,160,570 | 7/1979 | Bridges . | |
| 4,356,918 | 11/1982 | Kahle et al. | 206/444 |
| 4,380,293 | 4/1983 | Wilcox et al. | 206/378 X |
| 4,615,445 | 10/1986 | Stocchiero | 206/45.23 X |
| 4,802,605 | 2/1989 | Salmon et al. | 220/338 |

FOREIGN PATENT DOCUMENTS

| | | | |
|---|---|---|---|
| 926597 | 10/1947 | France | 206/45.23 |
| 7806720 | 12/1978 | Netherlands | 220/335 |

*Primary Examiner*—Bryon P. Gehman

*Attorney, Agent, or Firm*—Sandler, Greenblum & Bernstein

[57] ABSTRACT

A storage and display case includes a base having recesses for holding tools. The base includes front and rear angled sides that are angled outwardly from a bottom surface towards a top surface. A transparent cover is pivotally mounted on the base on an axis that is substantially parallel to the rear angled side, and is adapted to pivot between a closed position wherein the case is covered and an open position wherein the cover abuts the rear angled side. A mechanism is provided for maintaining the cover in its fully opened position with the cover abutting the rear angled side. When the cover is in its open position, with the cover abutting the rear angled side, the case can be supported on the cover with the base being at an angle to the horizontal that permits easy access to any tools contained therein. A hook portion can be placed along the front angled side whereby the case can be suspended from a hanger strip mounted on a wall. Further, a handle is spaced from the base, which allows for convenient carrying of the case.

43 Claims, 3 Drawing Sheets

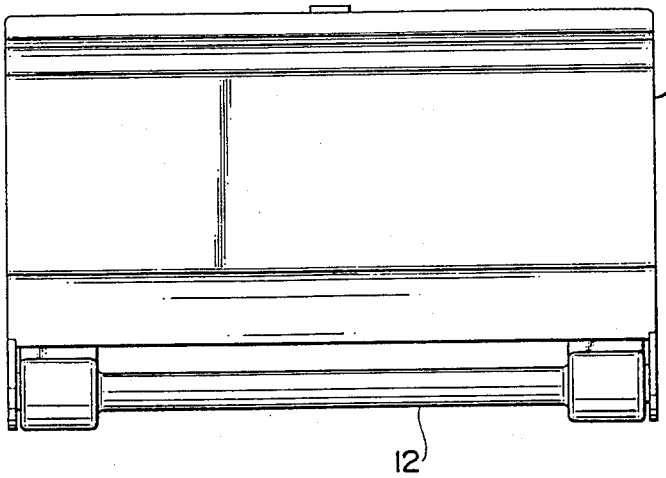
Fig. 3
Fig. 4
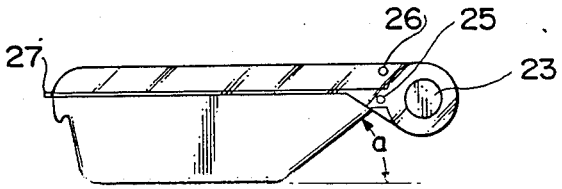
Fig. 5
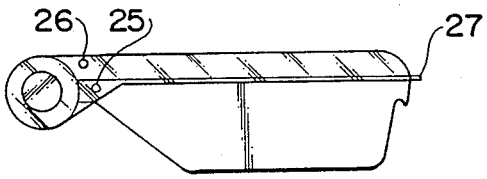

Fig. 6
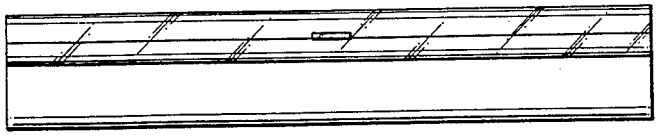
Fig. 7
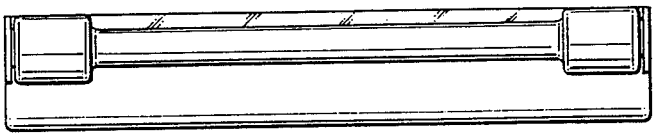
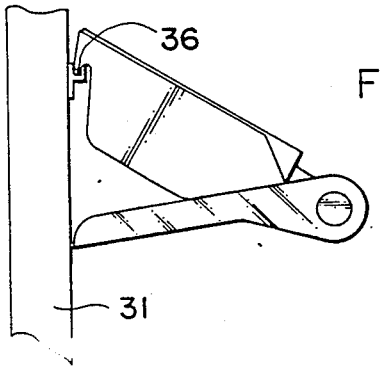
Fig. 8
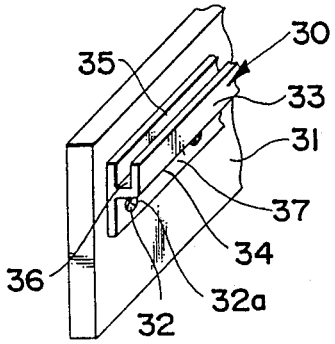
Fig. 10
Fig. 9
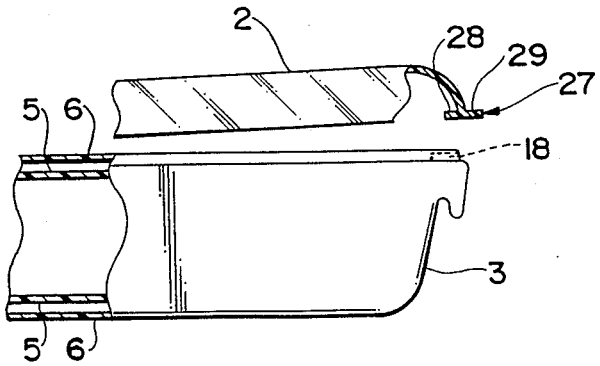

STORAGE AND DISPLAY CASE HAVING PIVOTALLY MOUNTED COVER

BACKGROUND OF THE INVENTION

1. Field of the Invention

The present invention relates generally to a case for storing objects. More particularly, the present invention relates to a case for storing and displaying objects, such as tools. Specifically, the case according to the present invention can constitute a portable case for storing and displaying hand tools such as a socket set, or portable electric hand tools, such as an electric drill.

2. Discussion of Background and Material Information

Portable cases are well known and are available in a wide variety of sizes and styles for holding various objects. Referring to tool boxes, while these known cases have the obvious advantage of being able to maintain the tools in an orderly and convenient manner, the known cases do not readily display the tools either for sale or for use. Further, the known cases have the disadvantage that their covers occupy an excessive work area when in the open position.

SUMMARY OF THE INVENTION

It is an object of the present invention to provide a storage case for objects, such as tools, which permits easy access to the objects contained therein while being of a space-saving design.

Further, it is an object of this invention to provide for the storage and display of objects in a case wherein the cover includes a dual function of permitting viewing of the contained objects, such as tools, and providing for the support of the case.

Still another object of the present invention is to provide a combination of a wall hanger with a storage case for objects, such as tools, wherein the storage case, when opened, can be suspended from the wall hanger, thereby providing ready access to the tools while saving valuable workbench space.

The present invention achieves these objectives by providing a case which includes a base having at least one recess adapted to hold such objects. The base includes a bottom surface and a top surface, with the top and bottom surfaces being surrounded by two opposing lateral ends and two opposing sides. At least one of the sides is angled outwardly from the bottom portion towards the top portion forming a front angled side. A cover is pivotally mounted on the base on an axis that is substantially parallel to the rear angled side, and is adapted to pivot between a closed position wherein the case is covered and an open position wherein the cover abuts the rear angled side. When the cover is in its open position, with the cover abutting the rear angled side, the base can be supported on the cover with the base being at an angle to the horizontal that permits easy access to any objects contained therein.

The storage case can be provided with means for maintaining the cover in its fully opened position with the cover abutting the rear angled side. These means can include a detent on the cover and a cavity on the base portion. The detent enters the cavity when the cover is in its fully opened position, with the cover abutting the rear angled side to hereby maintain the fully opened position of the cover even when the case is lifted.

In one aspect of the invention, the cover is transparent to thereby permit viewing of the contents of the case when the cover is in its closed position. Relating to this, the case can be securely fastened in a closed position, such as with adhesive tape, for sale to a customer. This would permit viewing of the contents of the case by the customer without requiring that the case be opened. In other words, even though a customer would not be able to readily open the case due to the case being securely fastened, the customer would be able to view its contents. Of course, this would reduce loss of tools caused by shoplifting.

In another aspect of the invention, the base is provided with a handle. The handle can be formed by providing the base with two base projections that extend outwardly on opposing ends of the base past the rear angled side, with the handle extending from one base projection to the other base projection. The handle is substantially parallel to the rear angled side and spaced therefrom a sufficient distance to permit a user to grasp the handle.

In another embodiment of the invention, a hook portion is provided that extends along at least a portion of the front side. This hook portion is utilized to hang the case from a wall hanger strip. Preferably, the hook portion extends substantially along the entire length of the front angled side. Moreover, the front side can angle outwardly from the bottom surface to the top surface thereby forming a front angled side.

In another aspect of the invention, a recessed lip is provided around at least a portion of the circumference of the top surface of the base. The edges of the cover fit into this recessed lip to assist in maintaining the cover in a fixed closed position.

The pivotal movement of the cover can be achieved by utilizing various pivotal mountings. For example, an outwardly directed circular protrusion can be provided on each base projection, with the cover being provided with a main cover portion and two cover projections extending outwardly from the main cover portion. Each cover projection is provided with an aperture that is dimensioned to fit around the circular protrusions to permit the cover to pivot between its open and closed positions.

Means for latching the cover to the base can also be provided. Preferably, the means for latching includes a latch recess located in the base. An inner latch protrusion extending into the latch recess when the cover is in its closed position, and an outer latch protrusion extends outwardly of the cover. When pressure is exerted on the cover and the outer latch protrusion is lifted, there is sufficient flex in the cover for the inner latch protrusion to be pulled out of the latch recess.

The base can be constructed with a double wall construction utilizing a blow molding method of construction with a plastic material such as polyethylene. The cover can be injection molded from a plastic material, including polyethyleneterephthalate, styrene acrylonitrile or a polycarbonate.

The angle of the rear angled side with respect to a horizontal plane passing along the bottom surface of the base can be varied depending upon the desired angle of the base to the horizontal when the case is supported on the cover. Preferably, the angle of the rear angled side with respect lo a horizontal plane passing along the bottom surface of the base is about 35° to 37°.

In another embodiment of the present invention, a storage and display case is provided having a base which includes at least one recess adapted to hold objects. The base includes a bottom surface and a top surface, with the top and bottom surfaces being surrounded by two opposing lateral ends and two opposing sides. The two sides are angled outwardly from the bottom surface towards the top surface forming a front angled side and a rear angled side. A transparent cover is pivotally mounted on the base on an axis that is substantially parallel to the rear angled side, and is adapted to pivot between a closed position wherein the base is covered and an open position wherein the cover abuts the rear angled side. Means are provided for maintaining the cover in its fully opened position with the cover abutting the rear angled side. Accordingly, when the cover is in its open position, with the cover abutting the rear angled side, the base can be supported on the cover with the base being at an angle to the horizontal that permits easy access to any objects contained therein.

In still another embodiment of the present invention, a storage and display case is provided having a base which includes at least one recess adapted to hold objects. The base includes a bottom surface and a top surface, with the top and bottom surfaces being surrounded by two opposing lateral ends and two opposing sides. The two sides are angled outwardly from the bottom surface towards the top surface forming a front angled side and a rear angled side. A transparent cover is pivotally mounted on the base on an axis that is substantially parallel to the rear angled side, and is adapted to pivot between a closed position wherein the base is covered and an open position wherein the cover abuts the rear angled side. Means are provided for maintaining the cover in its fully opened position with the cover abutting the rear angled side. The base includes two base projections that extend outwardly on opposing ends of the base past the rear angled side. A handle extends from one base projection to the other base projection, with the handle being substantially parallel to the rear angled side and spaced therefrom a sufficient distance to permit a user to grasp the handle. Moreover, means are provided for latching the cover to the base. Accordingly, when the cover is in its open position, with the cover abutting the rear angled side, the base can be supported on the cover with the base being at an angle to the horizontal that permits easy access to any tools contained therein.

In these further embodiments, the means for maintaining the cover in its fully opened position can include a detent mounted on the cover and a cavity on the base. In operation, the detent enters the cavity when the cover is in its fully opened position with the cover abutting the rear angled side.

Further, in these further embodiments, the front angled side can include a hook portion that extends at least along a portion of the front angled side, and preferably along the entire length thereof.

Moreover, these embodiments of the present invention can include any of the features described above, in any combination. In this regard, the cover can be pivotally mounted on circular protrusions that extend outwardly on base projections which form a handle, and a recessed lip can be provided around at least a portion of the circumference of the base. Further, these embodiments of the present invention can include the previously described specific latch mechanism, specific plastic materials of construction, and specific preferred angle for the rear angled side.

In still another embodiment of the invention, a combination of a storage case and a wall hanger strip for hanging the storage case from a wall is provided. The storage case is provided with a base having at least one recess adapted to hold objects. The base includes a bottom surface and a top surface, with the top and bottom surfaces being surrounded by two opposing lateral ends and two opposing sides. The two sides are angled outwardly from the bottom surface towards the top surface forming a front angled side and a rear angled side. A cover is pivotally mounted on the base on an axis that is substantially parallel to the rear angled side, and is adapted to pivot between a closed position wherein the base is covered and an open position wherein the cover abuts the rear angled side. Means are provided for maintaining the cover in its fully opened position with the cover abutting the rear angled side. The front angled side includes a hook portion that extends at least along a portion of the length of the front angled side. Moreover, means are provided for latching the cover to the base. The combination further includes a wall hanger strip adapted to be attached to a wall. The wall hanger strip includes elongated front, bottom and back walls forming an elongated channel into which the hook portion of the front angled side is adapted to be inserted. Accordingly, when the cover is in its open position, with the cover abutting the rear angled side, the case can be suspended from the wall hanger strip with the base resting at an angle to the horizontal that permits easy access to any objects contained therein.

The elongated back wall of the wall hanger strip can extend downwardly and be provided with apertures.

This embodiment of the invention can also include any of the features described above in any combination. In this regard, the cover can be transparent; outwardly extending projections on opposing ends of the base can support a handle and include circular protrusions functioning as a pivot point for the cover; and a recessed lip can be provided around the circumference of the base. Further, this embodiment can include the previously described specific latch mechanism, specific plastic materials of construction, and specific preferred angle for the rear angled side.

BRIEF DESCRIPTION OF THE DRAWING

The invention will now be described with reference to the non-limiting examples demonstrating various embodiments of the present invention, with reference to the annexed drawing, in which:

FIG. 3 illustrates a bottom plan view of the storage and display case according to the invention.

FIG. 4 illustrates a left hand side view of the storage and display case according to the invention.

FIG. 5 illustrates is a right hand side view of the storage and display case according to the invention.

FIG. 6 illustrates a front plan view of the storage and display case according to the invention.

FIG. 7 illustrates a back plan view of the storage and display case according to the present invention.

FIG. 8 illustrates the storage and display case according to the present invention suspended on the wall on the wall hanger strip.

FIG. 9 illustrates a side view in partial cross-sectional showing the latch mechanism.

FIG. 10 illustrates a perspective view of the wall strip hanger.

DETAILED DESCRIPTION OF THE PREFERRED EMBODIMENT

Figure 1:
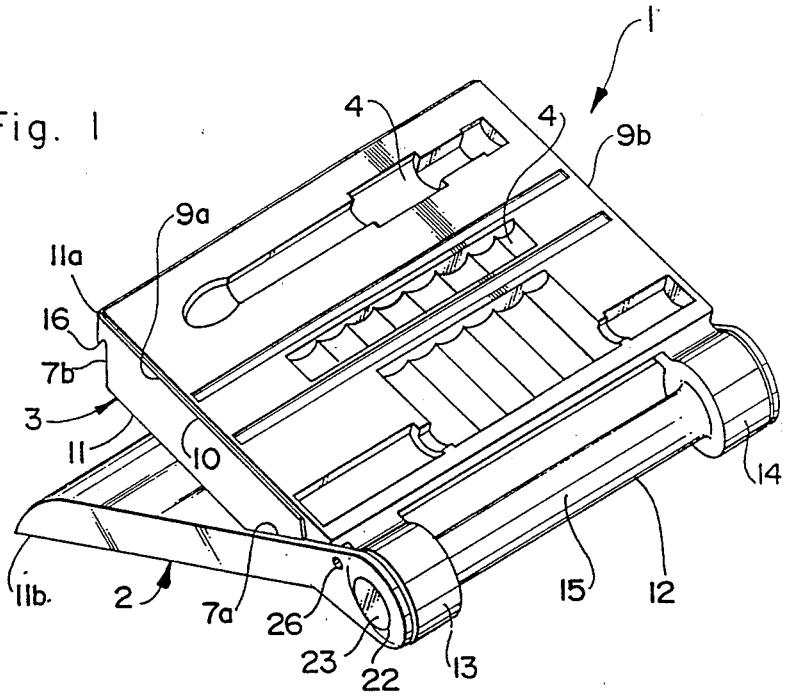
FIG. 1 illustrates a perspective view of the storage and display case according to the invention.
Figure 2:
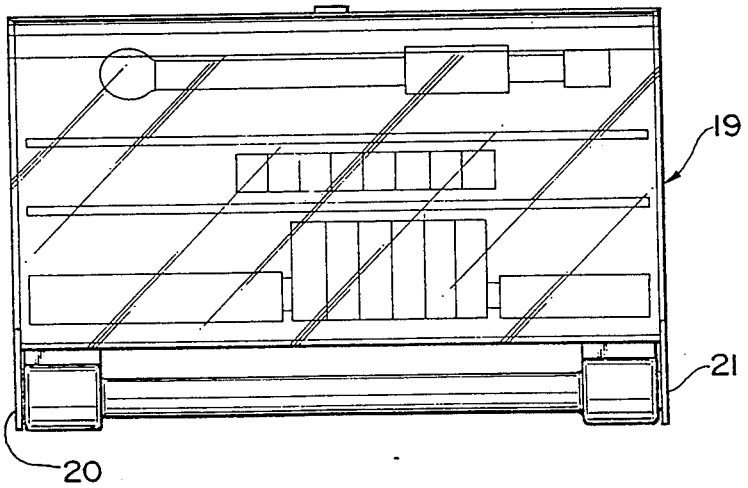
FIG. 2 illustrates a top plan view of the storage and display case according to the invention.

A preferred embodiment of the present invention is shown in the drawing as a storage and display case 1. As shown in FIG. 1, the storage and display case 1 includes a cover 2 and a base 3. The base 3 includes a plurality of recesses 4 for holding a variety of tools. The specific shape of the recesses illustrated in the drawing are only exemplary with the shape of the recesses being dependent on the intended tool to be stored. The base 3 is preferably formed of a double wall construction having an inner wall 5 and an outer wall 6. Preferably, base 3 is blow molded with a plastic material such as polyethylene.

As shown in FIG. 1, the base portion has opposing angled sides 7*a* and 7*b*, opposing lateral ends 9*a* and 9*b*, a top 1O, and a bottom 11. The base has an outer recessed lip portion ll*a* around its circumference, into which recessed lip an outer edge 11*b* of the cover 2 is adapted to engage. This engagement of the outer edge ll*b* of the cover 2 with the recessed lip 11*a* ensures the maintenance of the cover 2 in a fixed, closed position.

At the rear angled side 7*a* of the base 3 is a means forming a handle 12. The means forming a handle 12 includes two base projections 13 and 14 extending outwardly from opposing ends 9*a* and 9*b* of the base 3. A handle 15 extends from one base projection 13 to the other base projection 14. The handle is substantially parallel to the rear angled side 7*a*, and is spaced therefrom a sufficient distance to permit a person to grip the handle portion 15 with the fingers fitting into such spacing.

Further, on the front angled side 7*b* is located a hook portion 16 that preferably extends substantially along the entire length of the front angled side 7*b*. This hook portion 16 is adapted to fit in a channel 36 formed in a wall hanger strip 30 to permit the case 1 to be suspended on a wall.

Additionally, the base includes a latch recess 18 located at a substantially central area of the front angled side 7*b* in the recessed lip 11*a*.

The cover 2 includes a main cover portion 19 having two cover projections 20 and 21 extending outwardly from the main cover portion 19. Each cover projection 20 and 21 includes an aperture 22 that is dimensioned to fit around a circular protrusion 23 on each base projection 13 and 14 for pivotal movement of the cover 2 around the circular protrusions 23.

Cover 2 is adapted to be pivoted to an open position wherein it contacts the rear angled side 7*a* on the base 3. At such point of contact, pivotal movement of the cover 2 is no longer possible. In this opened position, the cover 2 is adapted to be utilized as a support for holding the base 3 at an angle to the horizontal for easy viewing and accessibility of the tools. Any suitable angle for the rear angled side can be utilized that would support the base 3 at a suitable angle. However, as shown in FIG. 4, the most preferred angle a of the rear angled side with respect to the horizontal is about 35° to 37°.

Preferably, the cover 2 includes a detent 25 on each cover projection 20 and 21, and a cavity 26 on each base projection 13 and 14 into which the detent 25 is adapted to fit. In this regard, when the cover 2 is in its fully opened position, with the cover abutting the rear angled side 7*a*, the detent 25 fits into the cavity 26. Accordingly, when the case is lifted, the detent 25 and cavity 26 will interact to maintain the cover 2 in its abutting position. Of course, the locations of the detent 25 and cavity 26 could be switched, with a detent being located on each base projection and a cavity on each cover projection. Also suitable, but less preferred, only one detent and cavity combination need be installed on the case.

Additionally, the cover 2 includes a latch 27 having two latch protrusions 28 and 29. Inner latch protrusion 28 is adapted to extend into latch recess 18 to maintain the cover 2 in a latched, closed position. Outer latch protrusion 29 extends outwardly of the case whereby when the cover 2 is in its closed position the outer latch protrusion 29 can be manipulated to open the case. In this regard, the cover 2 can be opened by placing finger pressure on an area of the cover adjacent the latch 27 and lifting up on outer latch protrusion 29.

Preferably, the cover 2 is constructed from a transparent material so that the tools stored in the case can be viewed even when the cover 2 is in its closed position. The cover 2 can be produced by injection molding a suitable plastic material, including polyethyleneterephthalate, styrene acrylonitrile or a polycarbonate.

As illustrated in FIGS. 8 and 10, when the cover 2 is in its open position, the case may be suspended on a wall. In this embodiment, the hook portion 16 on the front angled side 7*b* is adapted to fit into the channel 36 of a wall hanger strip 30. Wall hanger strip 30 is attached to a wall 31, preferably by screws 32 extending through aperture 32*a* in downwardly extending portion 37, and includes elongated front wall 33, elongated bottom wall 34 and elongated back wall 35 forming the channel 36 into which the hook portion 16 is adapted to fit. To suspend the case on the wall, the cover is opened to its fully opened position with cover 2 abutting the rear angled side 7*a*. Then the hook portion 16 is inserted into the channel 36. Once the hook portion 16 is inserted into the channel 36, the case is permitted to pivot downwardly until the edge 24 of the cover comes into contact with the wall. At this point, the case is securely suspended on the wall hanger strip 30 for ready access to the tools stored therein. Preferably, wall hanger strip 30 is sufficiently long so that any desired number of cases can be suspended therefrom. For example, separate cases holding a socket set, a wrench set and an electric drill can be suspended adjacent to each other. Preferably, wall hanger strip is produced from extruded aluminum.

Although the invention has been described with reference to particular means, materials and embodiments, it is to be understood that the invention is not limited to the particulars disclosed and extends to all equivalents within the scope of the claims.

I claim:

1. A case comprising:

a base having at least one recess adapted to hold an object, said base including a bottom surface and a top surface, the top surface and the bottom surface being surrounded by two opposing lateral ends and two opposing sides, at least one of the two opposing sides being angled outwardly from the bottom surface towards the top surface forming a rear angled side, and the other of the two opposing sides is a front side and includes a hook portion that extends along at least a portion of its length;

a cover pivotally mounted on the base so as to rotate on an axis that is substantially parallel to the rear angled side, the cover being adapted to pivot between a closed position wherein the base is covered and an open position wherein the cover abuts the rear angled side;

whereby when the cover is in an open position, with the cover abutting the rear angled side, the case is supported on the cover with the base being at an angled to the horizontal that permits easy access to any objects contained therein.

2. The case according to claim 1, further comprising means for maintaining the cover in a fully opened position with the cover abutting the rear angled side.

3. The case according to claim 2, wherein the means for maintaining the cover in said fully opened position include a detent on the cover and a cavity on the base; said detent being adapted to enter the cavity when the cover is in its fully opened position with the cover abutting the rear angled side.

4. The case according to claim 1, wherein the cover is transparent.

5. The case according to claim 1, wherein the base includes two base projections, each of said base projections extending outwardly on one of the opposing ends of the base past the rear angled side; and a handle extending between said base projections, substantially parallel to the rear angled side and spaced therefrom a sufficient distance to permit a user to grasp the handle.

6. The case according to claim 5, wherein the two base projections include outwardly directed circular protrusions; the cover includes a main cover portion and two cover projections; and each of the cover projections including an aperture that is dimensioned to fit around the circular protrusions to permit the cover to pivot between its open and closed positions.

7. The case according to claim 1, wherein the other of the two opposing sides is an angled front side.

8. The case according to claim 1, wherein the hook portion extends substantially along the entire length of the front side.

9. The case according to claim 1, wherein the base includes a recessed lip around at least a portion of the circumference of the top surface.

10. The case according to claim 1, further including means for latching the cover to the base.

11. The case according to claim 10, wherein the means for latching includes a latch recess located in the base; an inner latch protrusion adapted to extend into the latch recess when the cover is in its closed position; and an outer latch protrusion which extends outwardly of the cover, whereby when pressure is exerted on the cover and the outer latch protrusion is lifted, there is sufficient flex in the cover for the inner latch protrusion to be pulled out of the latch recess.

12. The case according to claim 1, wherein the base has a double wall construction.

13. The case according to claim 1, wherein the base and cover comprise plastic materials.

14. The case according to claim 13, wherein the base comprises polyethylene, and the cover comprises polyethyleneterephthalate, styrene acrylonitrile or a polycarbonate.

15. The case according to claim 1, wherein the angle of the rear angled side with respect to a horizontal plane passing along the bottom surface of the base is about 35° to 37°.

16. A storage and display case comprising:

a base having at least one recess adapted to hold an object, said base including a bottom surface and a top surface, the top surface and the bottom surface being surrounded by two opposing lateral ends and two opposing sides, the two opposing sides being angled outwardly from the bottom surface towards the top surface forming a front angled side and a rear angled side, and said front angled side includes a hook portion that extends along at least a portion of its length;

a transparent cover pivotally mounted on the base so as to rotate on an axis that is substantially parallel to the rear angled side, the cover being adapted to pivot between a closed position wherein the case is covered and an open position wherein the cover abuts the rear angled side; and means for maintaining the cover in its fully opened position with the cover abutting the rear angled side;

whereby when the cover is in an open position, with the cover abutting the rear angled side, the base is supported on the cover with the base being at an angle to the horizontal that permits easy access to any objects contained therein.

17. The storage and display case according to claim 16, wherein the means for maintaining the cover in said fully opened position include a detent and a cavity; said detent being adapted to enter the cavity when the cover is in its fully opened position with the cover abutting the rear angled side.

18. The storage and display case according to claim 16, wherein the hook portion extends substantially along the entire length of the front angled side.

19. The storage and display case according to claim 16, wherein the base includes a recessed lip around at least a portion of the circumference of the top surface.

20. The storage and display case according to claim 16, wherein the base includes two base projections, each of said base projections extending outwardly on one of the opposing ends of the base past the rear angled side; and a handle extending between said base projections substantially parallel to the rear angled side and spaced therefrom a sufficient distance to permit a user to grasp the handle.

21. The storage and display case according to claim 20, wherein the two base projections include outwardly directed circular protrusions; the cover includes a main cover portion and two cover projections; and each of the cover projections including an aperture that is dimensioned to fit around the circular protrusions to permit the cover to pivot between its open and closed positions.

22. The storage and display case according to claim 16, further including means for latching the cover to the base.

23. The storage and display case according to claim 22, wherein the means for latching includes a latch recess located in the base; an inner latch protrusion adapted to extend into the latch recess when the cover is in its closed position; and an outer latch protrusion which extends outwardly of the cover, whereby when pressure is exerted on the cover and the outer latch protrusion is lifted, there is sufficient flex in the cover for the inner latch protrusion to be pulled out of the latch recess.

24. The storage and display case according to claim 16, wherein the base has a double wall construction.

25. The storage and display case according to claim 16, wherein the base and cover comprise plastic materials.

26. The storage and display case according to claim 25, wherein the base comprises polyethylene, and the cover comprises polyethyleneterephthalate; styrene acrylonitrile or a polycarbonate.

27. The storage and display case according to claim 16, wherein the angle of the rear angled side with respect to a horizontal plane passing along the bottom surface of the base is about 35° to 37°.

28. A storage and display case comprising:

a base having at least one recess adapted to hold objects, said base including a bottom surface and a top surface, the top surface and the bottom surface being surrounded by two opposing lateral ends and two opposing sides, the two opposing sides being angled outwardly from the bottom surface towards the top surface forming a front angled side and a rear angled side;

a transparent cover pivotally mounted on the base so as to rotate on an axis that is substantially parallel to the rear angled side, the cover being adapted to pivot between a closed position wherein the base is covered and an open position wherein the cover abuts the rear angled side;

means for maintaining the cover in its fully opened position with the cover abutting the rear angled side;

the base includes two base projections, each of the base projections extending outwardly on one opposing end of the base past the rear angled side; and a handle extending between said base projections substantially parallel to the rear angled side and spaced therefrom a sufficient distance to permit a user to grasp the handle;

the front angled side includes a hook portion that extends substantially along the length of the front angled side; and means for latching the cover to the base;

whereby when the cover is in its open position, with the cover abutting the rear angled side, the base can be supported on the cover with the base being at an angle to the horizontal that permits easy access to any objects contained therein.

29. In combination, a storage case and a wall hanger strip for hanging the storage case from a wall comprising:

a base having at least one recess adapted to hold objects, said base including a bottom surface and a top surface, the top surface and the bottom surface being surrounded by two opposing lateral ends and two opposing sides, at least one of said two opposing sides being angled outwardly from the bottom surface towards the top surface forming a rear angled side;

a cover pivotally mounted on the base so as to rotate on an axis that is substantially parallel to the rear angled side, the cover being adapted to pivot between a closed position wherein the base is covered and an open position wherein the cover abuts the rear angled side;

means for maintaining the cover in its fully opened position with the cover abutting the rear angled side;

the other of the two opposing sides is a front side and includes a hook portion that extends along at least a portion of its length;

means for latching the cover to the base; and a wall hanger strip capable of being attached to a wall, said wall hanger strip including elongated front, bottom and back walls forming an elongated channel into which the hook portion of the front side is capable of being inserted;

whereby when the cover is in its open position, with the cover abutting the rear angled side, the case can be suspended from the wall hanger strip with the base resting at an angle to the horizontal that permits easy access to any objects container therein.

30. The combination according to claim 29, wherein the cover is transparent.

31. The combination according to claim 29, wherein the base includes two base projections, each of said projections extending outwardly on one of the opposing end of the base past the rear angled side; and a handle extending between said base projections substantially parallel to the rear angled side and spaced therefrom a sufficient distance to permit a user to grasp the handle.

32. The combination according to claim 31, wherein the two base projections include outwardly directed circular protrusions; the cover includes a main cover portion and two cover projections; and each of the cover projections including an aperture that is dimensioned to fit around the circular protrusions to permit the cover to pivot between its open and closed positions.

33. The combination according to claim 29, wherein the means for maintaining the cover in said fully opened position include a detent and a cavity; said detent being adapted to enter the cavity when the cover is in its fully opened position with the cover abutting the rear angled side.

34. The combination according to claim 29, wherein the base includes a recessed lip around at least a portion of the circumference of the top surface.

35. The combination according to claim 29, wherein the means for latching includes a latch recess located in the base; an inner latch protrusion adapted to extend into the latch recess when the cover is in its closed position; and an outer latch protrusion which extends outwardly of the cover, whereby when pressure is exerted on the cover and the outer latch protrusion is lifted, there is sufficient flex in the cover for the inner latch protrusion to be pulled out of the latch recess.

36. The combination according to claim 29, wherein the base has a double wall construction.

37. The combination according to claim 29, wherein the base and cover comprise plastic materials.

38. The combination according to claim 37, wherein the base comprises polyethylene, and the cover comprises polyethyleneterephthalate, styrene acrylonitrile or a polycarbonate.

39. The combination according to claim 29, wherein the angle of the rear angled side with respect to a horizontal plane passing along the bottom surface of the base is about 35° to 37°.

40. The combination according to claim 29, wherein elongated back wall of the wall hanger strip includes a downwardly extending portion, and said downwardly extending portion includes apertures.

41. The combination according to claim 29, wherein the other of the two opposing sides is an angled front side.

42. The combination according to claim 29, wherein the hook portion extends substantially along the entire length of the front side.

43. A storage and display case for tools comprising:

a base having at least one recess containing at least one tool, said base including a bottom surface and a top surface, the top surface and the bottom surface being surrounded by two opposing lateral ends and two opposing sides, the two opposing sides being angled outwardly from the bottom surface towards the top surface forming a front angled side and a rear angled side;

a transparent cover pivotally mounted on the base so as to rotate on an axis that is substantially parallel to the rear angled side, the cover being adapted to pivot between a closed position wherein the base is covered and an open position wherein the cover abuts the rear angled side;

means for maintaining the cover in its fully opened position with the cover abutting the rear angled side;

the base includes two base projections, each of the base projections extending outwardly on one opposing end of the base past the rear angled side; and a handle extending between said base projections substantially parallel to the rear angled side and spaced therefrom a sufficient distance to permit a user to grasp the handle;

the front angled side includes a hook portion that extends substantially along the length of the front angled side; and means for latching the cover to the base;

whereby when the cover is in its open position, with the cover abutting the rear angled side, the base can be supported on the cover with the base being at an angle to the horizontal that permits easy access to said at least one tool.

* * * * *

UNITED STATES PATENT AND TRADEMARK OFFICE

CERTIFICATE OF CORRECTION

PATENT NO. : 4,930,628

DATED : June 5, 1990

INVENTOR(S) : John A. BRIDGES

It is certified that error appears in the above-indentified patent and that said Letters Patent is hereby corrected as shown below:

column 1, line 66, change "hereby" to ---thereby---;
column 2, line 65, change "lo" to ---to---;
column 5, line 20, change "10" to ---10---;
column 5, line 21, change "11a" to ---11a---;
column 5, line 24, change "11b" to ---11b---;
column 7, line 8 (claim 1, line 21), change "angled" to ---angle---;
column 10, line 8 (claim 29, line 34), change "container" to ---contained---; and
column 10, line 56 (claim 40, line 1) insert ---the--- after "wherein".

Signed and Sealed this

Third Day of May, 1994

Bruce Lehman

*Attest:*

BRUCE LEHMAN

*Attesting Officer*

*Commissioner of Patents and Trademarks*